US005149275A

United States Patent [19]

Pitta

[11] Patent Number: 5,149,275

[45] Date of Patent: Sep. 22, 1992

[54] CABLE CONNECTOR

[75] Inventor: Philippe Pitta, Fontaine, France

[73] Assignee: Bull, S.A., France

[21] Appl. No.: 487,996

[22] PCT Filed: Jul. 28, 1989

[86] PCT No.: PCT/FR89/00397

§ 371 Date: Jun. 18, 1991

§ 102(e) Date: Jun. 18, 1991

[87] PCT Pub. No.: WO90/01816

PCT Pub. Date: Feb. 22, 1990

[30] Foreign Application Priority Data

Jul. 29, 1988 [FR] France ..... 88 10279

[51] Int. Cl.[5] ..... H01R 4/66

[52] U.S. Cl. ..... 439/98; 439/497

[58] Field of Search ..... 439/496, 497, 609, 98

[56] References Cited

U.S. PATENT DOCUMENTS 4,337,989 7/1982 Asick et al. ..... 439/609

4,422,700 12/1983 Krenz ..... 439/497

4,619,487 10/1986 Brush ..... 439/497 X 4,758,179 7/1988 Klein et al. ..... 439/497

*Primary Examiner*—Eugene F. Desmond

*Attorney, Agent, or Firm*—Wolf, Greenfield & Sacks

[57] ABSTRACT

A cable connector for a multi-wire cable which includes a grounded casing and wherein the cable wires have their insulation stripped at one end, to expose the ground casing. The cable wires are connected to a socket. The one end of the cable is provided with a transfer piece of conductive metal to assure continuity of ground between connected equipment and the cable. The transfer piece is affixed mechanically to the ground casing and mechanically reinforces the cable connection to the socket. The transfer piece contains a part forming a catch which is made in the form of a comb having teeth bent in a U-shape to provide a flexible connection and at the same time a ground connection. The connector may further be provided with a clamp to press the transfer piece to the cable and assure contact of such piece with the grounded casing.

16 Claims, 2 Drawing Sheets

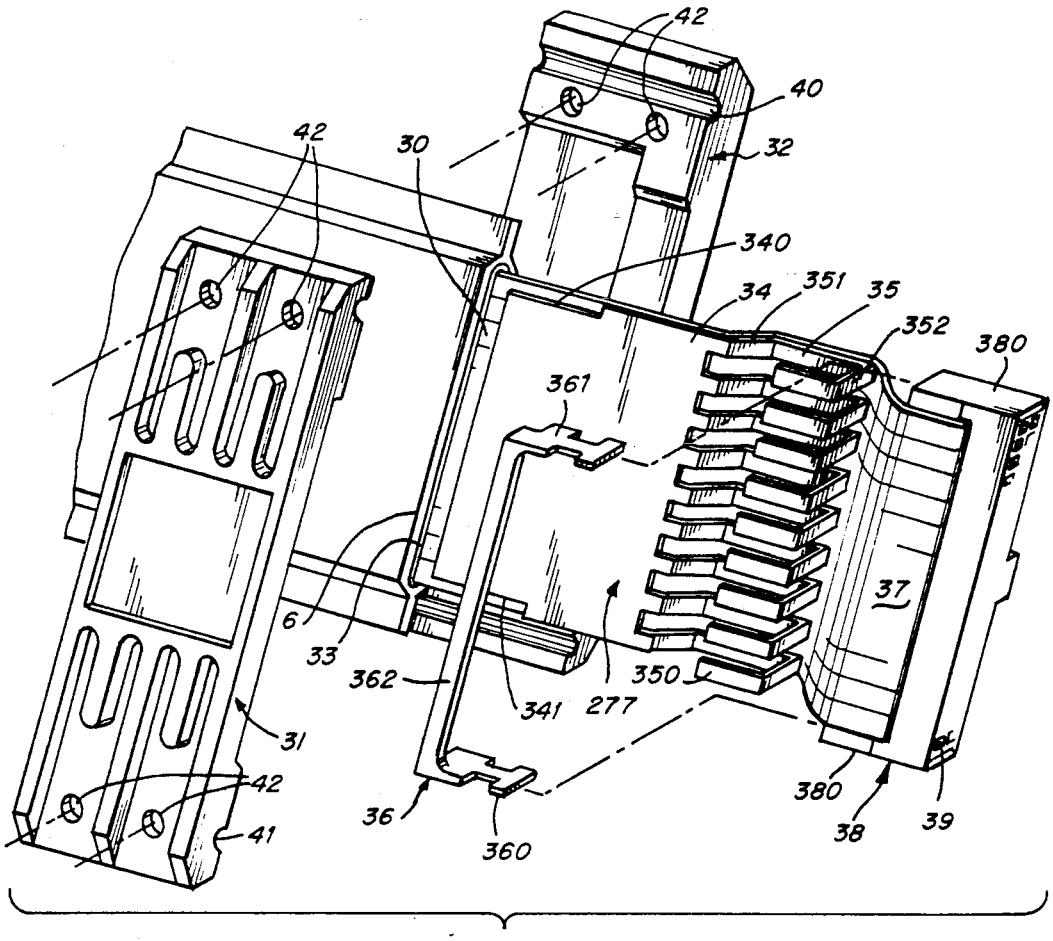
Fig. 3
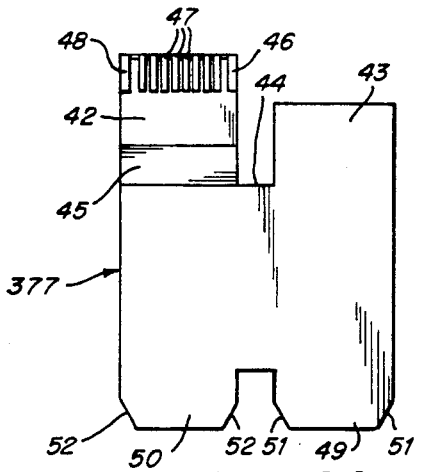
Fig. 4A
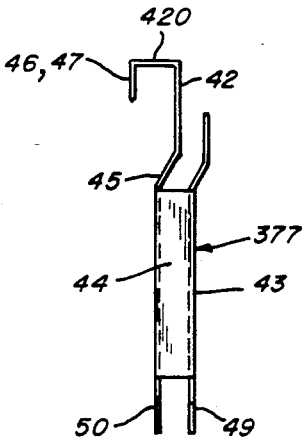
Fig. 4B
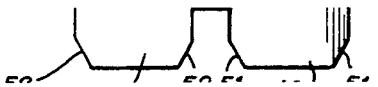
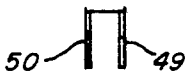

CABLE CONNECTOR

BACKGROUND OF THE INVENTION

The present invention concerns a cable connector. It is used in professional electronics, particularly to interconnect a layer of wire of any shape whatsoever. In one embodiment, it permits easy connection of bundles of cable to the equipment to which the cable is connected.

In the prior art, the making of cables of encased layers or even manufacturing coaxial cables in which the socket of a first type is used to connect into a socket of a second complementary type which is mounted on, and at the exterior of the device to be connected, is generally known.

When a connection is desired for signals that vary rapidly (data processing lines, connections from the central unit to peripherals, etc.), it is necessary to protect the signals that pass through the conductors from parasitic signals. For this purpose, the wires that transmit signals are grouped into cables and encased in a conductive covering connected to the ground potential.

But, the connection of the ground conductor sometimes poses a problem especially if it is desired to assure good continuity of ground between the connected equipment and assuring good protection of the connector itself.

Another notable disadvantage of cables of the prior art is their great fragility, principally owing to the connector that connects them to the device from the purely mechanical point of view.

In particular, in the case of data processing equipment, where the number and the space occupied by the connectors has increased significantly in the past few years, it becomes more and more difficult to make the socket on the equipment accessible. Then it is not unusual that the user would have to hunt through the bundle of cables taking up space on the face of the equipment on which the sockets exit to attempt to connect the cable that he wishes in the free connector.

SUMMARY OF THE INVENTION

The invention concerns a multi wire cable connector of the type containing a socket of a first type connected to the wires of one end of the cable, the connection being of the type that is connected to a socket of a second type.

It is a goal of the present invention in a data processing assembly connection to permit the electrical connection of the ground in an improved manner without causing significant extra costs.

It is another goal of the present invention to furnish a global solution that assures a better adaptation of an electrical connector to mechanical problems that are encountered by making connections and disconnections without going into the interior of the machine.

The invention is characterized notably by the fact that a socket of the first type contains a transfer piece which assures the screening at least upstream of such socket and having a mechanical rigidity in such a way as to mechanically reinforce the cable connection of such socket specifically at the time of its insertion into the second socket and a linking means of the socket of the first type with the transfer piece so constructed as to assure the transmission of mechanical stresses by the transfer piece at the time of extraction of such socket.

Another feature of the invention is that the transfer piece contains a part forming a catch designed to fit together in an opening in the equipment to be connected and thus insuring the electrical connection of the cable screening with the electrical ground of the machine.

In still another feature of the invention, the aforementioned catch is made in the form of a comb having teeth bent in a U-shape to improve the elastic qualities, and also contains two lateral shutters designed to guide the assembly at the time of insertion into the second socket.

According to another feature of the invention, a clamp is provided which presses on both sides of a cable and assures, by pressure, the electrical contact of a transfer piece with screening conductive fabric.

According to still another feature of the invention, the means of connection includes a U-shaped part of the socket of the first type, which is removable or not, forming a loop through which the teeth of the aforementioned comb pass.

BRIEF DESCRIPTION OF THE DRAWINGS

Other characteristics and advantages of the present invention will be better understood by reference to the description and the drawings, in which:

FIG. 3 is an exploded perspective view of a preferred embodiment of the invention, FIG. 4A is a plan view of another form of the transfer piece of the invention which is opened out flat, and FIG. 4B is a side view of the transfer piece of FIG. 4A but which is folded over to enclasp a flat cable.

DETAILED DESCRIPTION

Figure 1:
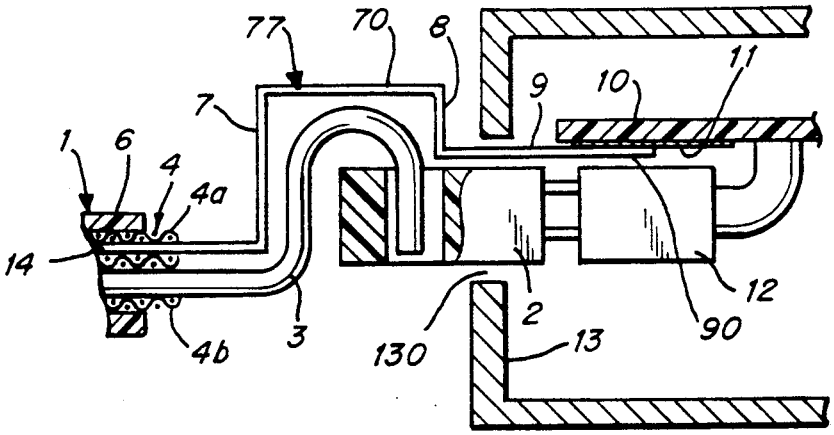
FIG. 1 is a cross section showing a first embodiment of the cable connector of the invention.

One embodiment of the invention has been represented in FIG. 1. A flat cable 1 is composed of a layer of wires 3 which are soldered laterally in a single plane perpendicular to the plane of the drawing. The cable consists of a protective sleeve 6 of supple plastic material. In the interior of the sleeve or sheath 6 is distributed a conductor fabric 4 which encircles the layer of wires 3. In FIG. 1, the fabric 4 has an upper face **4*a* and a lower face 4*b***.

The end of the layer of wires 3 is made bare by being cut away from the end of the cable 1 and the end of each wire 3 is connected to a socket or terminal 2. In one manner of accomplishing this, the ends of the wires 3 of the layer are connected by being auto-stripped by a device known in the art. This configuration is completely standard.

The mechanical joining of the wires can then be completed by a fastening device which will be described in more detail hereafter. For example, a clamp 31, 32 can be used to enclasp the wires (which will be described in more detail in connection with FIG. 3). A removable fastening of the socket 2 on the chassis 13 of the equipment to which the cable is connected is thus accomplished. According to one example of the invention, this clamp is composed of two parts made integral by screws which will engage themselves in the corresponding threaded openings in the chassis of the equipment, the effect of which is to mechanically join together the cable, its connector and the equipment to which it is electrically connected.

The continuity of the ground is accomplished by soldering a wire (not shown) onto the encasing fabric 4 which transmits the ground of the cable casing to the connector. The wire is either connected directly to the chassis of the equipment 13 or even connected to a prong of the socket 2. In particular, it can be noted that the socket 2 is exposed and it thus can also be irradiated by the electromagnetic energy issuing from the circulation of currents in the layer of wires 3, picked up issuing from an interfering radio-frequency field. It is thus necessary to protect the socket 2 against these disturbances, by making a blind connection in the interior of the equipment through an opening of the chassis 13 of the equipment.

It is clear that in such a configuration, the extraction or insertion of the encased cable is delicate, because it remains supple and it is necessary to grasp it by the body of the terminal or socket 2 to work effectively. But this is not always possible, as the terminal may have become inaccessible because of the space taken up by the other connectors in the equipment connection zone. Sometimes, in fact, the connector "disappears" between two of its neighbors, becoming largely inaccessible. In the same way, the joining of the connector 2 to the complementary terminal is done as shown in FIG. 1, blindly, through the opening 130 of the chassis 13 of the equipment. The user is then led to extract the connector by pulling on its cable. The end zone of the encased cable, at its attachment to the terminal 2, may then be subjected to pulling or torsion which contributes to the reduction of its service life and a reduction in its electrical functionability.

To improve this state of affairs, and as shown in FIG. 1, the invention proposes to insert in the cable a conducting transfer piece 77, exhibiting a certain mechanical rigidity. This transfer piece contains a first part 14 which is inserted between the encasing fabric 4 and the layer of wires 3 to contribute to the continuity of the casing of the part of the wire layer 3 not protected by the fabric 4. The piece also contains parts 7, 70, 8, and 9 which partially envelop the terminal 2 in such a way as to also constitute its casing. The parts 14, 7, 70, 8, 9 essentially form an open ended-covering wherein lateral branches 14 and 9 are in two staggered horizontal planes and the central part 7, 70, 8 forms an inverted U. The terminal 2 is made integral with the horizontal part 9 of the transfer piece 77.

Finally, it is possible to equip the part 9 of the transfer piece 77 with an extension 90 which is intended to penetrate into the interior of the device to connect, in a such a way as to be in electrical contact with a connection element 10 through an opening 130 provided for this purpose in the housing 13 of the equipment. This element 10 in a preferred form, contains a conducting track 11, engraved on its surface in the manner of a printed circuit card. The extension 90 of the transfer piece will electrically contact this conducting zone 11 thus realizing a connection of the ground casing of the cable casing 4 to the ground of the printed circuit on which the cable signals are processed. The socket 2 is made mechanically integral with either the part 8 or 9 of the transfer piece 77 to prevent the phenomenon of the cable 3 pulling out of the socket 2 when it is extracted.

It is clear that this description of an encased cable adapts itself easily to the case of a simple cable, furnishing it a supplementary mechanical protection and an operability that has been not known up to the present time.

In one embodiment, the casing fabric 4 is composed of a sheet of intertwined fine electrical wires. The sheet is folded around the flat ribbon of conductors to be encased. The two edges of the sheet cover each other on one of the front plates of the ribbon. A casing that is simple and easy to assemble is obtained in this way.

Figure 2A:
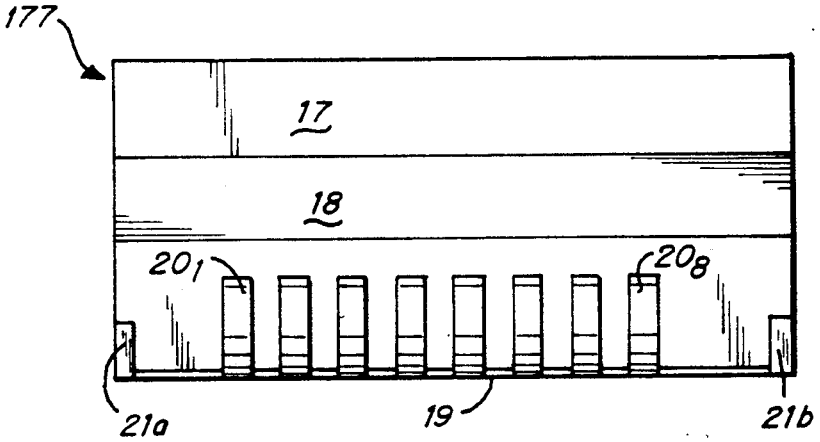
FIG. 2A is a front view of a portion of a transfer piece of another embodiment of the connector of the invention.
Figure 2B:
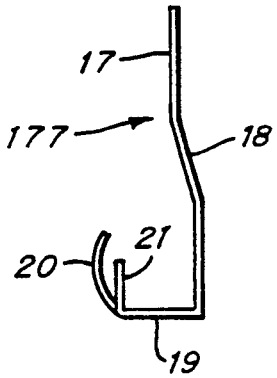
FIG. 2B is a right side view of the transfer piece of FIG. 2A.

In FIGS. 2A and 2B, a front view and side view of another embodiment of a transfer piece of the invention is represented. In this configuration, the transfer piece 177 includes a first part 17 meant to be introduced between the conductors 3 and, in one form of construction a sheath, or in a second form of construction, a locking clamp, as will be seen in connection with the discussion of FIG. 3.

When the transfer piece 77 or 177 is mounted on a connector in the manner described above having a first socket, the second part 8 or 18 of the transfer piece 77 or 177 permits pushing the first socket while resetting the axis of compression or mechanical tension on the axis of the second socket 12. This compression or its inverse, the tension, performed in the axis of the connector composed of the assembly of the two sockets 2 and 12 is facilitated by the relationship of the parts in the prior art.

The second part 18 is connected by a part 19 to form a U which encircles the greater part of the first socket in such a way as to constitute its casing.

The second branch 19 of the U is connected to two parts 20 and 21 which have two functions. The lateral shutters **21*a* and 21*b* permit guiding the first socket 2 into an entrance channel of the second socket 12. The comb 20 is composed of 8 bent clamps $\mathbf{20}_1$ to $\mathbf{20}_8$, and forms an electrical contact between the transfer piece 177 and at least one zone of electrical ground, either the second socket 12** or directly with the device to which the cable is connected.

The teeth 20 are meant to form a retaining clamp for the first socket 2 with the second socket 12. To this end, the comb made up by the teeth $\mathbf{20}_1$ through $\mathbf{20}_8$ flatten out upon the insertion of the first socket 2 into a unit containing the second socket 12 and of which one edge contains a retaining device for the ends of the teeth 20 of the comb.

The spring-like effect caused by the flattening of the teeth serves to provide a positive retention. In particular, this solution is used when the two connected sockets can not be made integral by external fastening devices such as screws.

In FIG. 3, an exploded view of a preferred embodiment of a connector according to the invention is represented. The flat cable 30 is in the interior of a protective sheath 1. The first socket 38 is a connector of the type HE10 with two rows of holes 39 meant to receive the corresponding connection hooks of the second socket. This second receptacle socket is joined to the printed circuit on the rear face of an electrical device like a computer peripheral. The second socket 12 is mounted as shown in FIG. 1 in the interior of the opening 130 of the equipment 13 and recessed with respect to such access opening 130.

The sockets 38, 12 are of the type known as "insulation- removed connectors." In this type of technology, the insulation encircling the conductive wires of the layer 37 is cut and displaced by devices connected electrically to the contacts accessible by the holes 39 of the first socket 38. These devices permit piercing the insulation to establish a convenient electrical contact between the conductor and the pin of the first socket which is fixed to it.

The transfer piece 277 having parts 34 and 35 is inserted between the loop formed by the layer 37 and a fastening piece 36 which will clamp the layer on the connection (socket) 38.

To permit a certain flexibility to the insertion and an electrical contact on a conducting area mounted in front of the receptacle socket of the socket 38 a first part 35 of the transfer piece 277 is arranged in a comb of nine teeth curved in a U-shape which extends by springing back to the rear of the socket 38, being lightly wedged against the base in relationship to it.

The end 34 of the transfer piece 277 is formed as a plate 34 and is meant to come into electrical contact with the encasing fabric 33. This plate 34 of the transfer piece 277 contains small pieces 340, 341 in the form of notches in such a way as to facilitate the mounting in the flat cable 30 that is sheathed and/or encased.

For this reason, one end of the plate 34 of the transfer piece 277 leading to the fabric 33 has a reduced size but is enlarged towards its other end adjacent to a portion 351 of the comb 35. The latter end of the plate 34 is contained in a plane that is parallel and shifted forward in relationship to the plane of part 35 which forms a U-shape together with the parts 351 and 352.

A fastening piece 36 likewise essentially in the form of a U is mounted in such a way that the central part 362 of the U of the piece 36 will be placed between the arms of the comb 35. The ends of the arms of piece 36 contain lugs 360, 361 which will clip into corresponding holes provided in the side plates 380 of the socket 38.

Two jaws 31 and 32 of a clamp will enclose the end 34 of the conducting transfer piece 277 on the cable 1 and simultaneously assure mechanical cohesion and electrical continuity of the casing 33 on the part 34 of the transfer piece 277.

The two jaws 31 and 32 are attached one to the other by four screws provided for that purpose which pass through holes 42. Additionally, the clamp may contain two screws passing through the cylindrical openings formed by semi-cylindrical openings 40, 41 in the respective jaws 32, 31. Each of these screws is designed to penetrate into a corresponding thread formed in the chassis of the equipment on which the cable is to be attached.

The jaws 31 and 32 have a dimension and form adapted in relationship to the transfer piece 277 so that the removal of the piece 36 out of the comb 35 when subjected to stress is not possible. At the time of insertion, the bundle 37 and the socket 38 will be supported on the central part of the U of the teeth 35, while at the time of extraction of the socket 38, the piece 36 will abut on the central part of the U of the teeth of the comb 35.

In a further embodiment not shown in the Figures, the transfer piece according to the invention is fixed mechanically to the flat cable by gluing. When the cable is encased, a glue with conductive characteristic is used. If the cable is not encased, the glue acts on the mechanical contact between the bundle of conductors and the transfer piece or between the cable sheath and the transfer piece.

A further embodiment of the invention is represented in FIGS. 4A and 4B. The transfer piece 377 is folded over on the other face of the band of conductors that make up the flat cable. The two sections 43 and 45, 42, 420 and 47 of the transfer piece 377 are joined by a transition part 44 which must be folded at the time of assembling the conductor on its cable. The second section has its parts 42, 420 and 47 formed into a U-shape of conducting sheet metal. The part 42 of the U is provided with the teeth 47 and the two side shutters 46, 48.

The ends 49, 50 of the sections 43 and 45 respectively are introduced into the flat cable and include, in a preferred embodiment, notches 51 and 52, respectively, that reduce their size in order to facilitate the insertion of the transfer piece 377 into a cable sheath.

To mount the connector in the embodiment of FIGS. 4A and 4B, the user must first make the connections of the conductor wires on a first socket. The transfer piece 377 which is delivered in the form shown in FIG. 4A is then folded. The transfer piece 377 is then inserted at its ends 49, 50 into a sheath and/or casing encircling a bundle of connectors between the two. Finally, the transfer piece 377 is assembled on the first socket using the relative flexibility of the transfer piece, the folded transfer piece having the appearance represented in FIG. 4B.

The user then attaches the first socket by an analogous piece to the piece 36 in FIG. 3 and if necessary by a clamp such as 31, 32 in such a way as to compose mechanically an assembly that is mechanically unified and made up of the cable, the first socket and the transfer piece 377.

The connected cable, is thus encased in a rapid and economical manner that is efficient at the same time, and permits blind connection across a panel by the rigidity lent by the transfer piece. Numerous electrical connections and disconnections may be performed without deterioration of the flexible cable, while at the same time assuring the electrical continuity of the casing by contact on a plate of copper of the printed circuit.

The invention permits numerous adaptations, particularly in the case of a transfer piece completely encircling the first socket. It adapts itself in particular to the cables that are not only flat, but of all shapes.

In addition, the second socket itself can be connected to a second cable and not, as described here, to an electrical device.

These and other modifications of the cable connector of the invention may be made without departing from the spirit and scope of the invention.

What I claim is:

1. A multi-wire cable connector comprising in combination:

a cable having a plurality of conducting wires and a grounding element;

a first socket connected to said cable;

a second socket mounted into a piece of electrical equipment and into which said first socket is to be connected; and a transfer part provided with a plurality of flexible contact fingers having elastic properties and bent into a U-shape, said transfer part being adapted to be engaged within said equipment to provide an electrical ground connection, and adapted to be connected to the grounding element of said cable and mechanically assembled to said first socket whereby electrical continuity of the grounding element is assured upstream of the first socket while simultaneously assuring mechanical reinforcement of the cable connection to said first socket, whereby repeated insertions and extractions of the first socket into the second socket will be withstood without causing electrical disconnect of any of said conducting wires.

2. The cable connector of claim 1 wherein the equipment is provided with grounding means and said fingers come into contact with said grounding means upon cable connection to said second socket.

3. The cable connector of claim 1 wherein said transfer part is mechanically assembled to said cable by guiding with a glue having conductive qualities.

4. The cable connector of claim 1 including a clamping means arranged to enclasp said transfer part to said cable.

5. The cable connector of claim 4 wherein said cable is in the form of a flat bundle of wires having a portion of the electrical insulation removed therefrom, and said clamping means consists of two flat members which are enclasped around said cable at the location where the insulation is removed in order to ensure positive contact of said transfer part with the grounding element of said cable.

6. The cable connector of claim 1 wherein the transfer part is provided with guide strips to enable ease of assembly upon insertion of the first socket into the second socket.

7. The cable connector of claim 6, including a fastening means outboard of said grounding element for enclasping said wires to said first socket.

8. A multi-wire cable connector for interconnecting a cable to a second socket mounted into a piece of electrical equipment comprising in combination:

a cable having a plurality of conducting wires encased in a grounding element, said wires being stripped of their insulation at one end and extending past the grounding casing;

a first multi-pin socket connected to said cable at said one end; and a transfer part provided with a plurality of flexible contact fingers having elastic properties and bent into a U-shape, said transfer part being adapted to be engaged within said equipment to provide an electrical ground connection, and adapted to be connected to the grounding element of said cable and mechanically assembled to said first socket whereby electrical continuity of the grounding element is assured upstream of the first socket while simultaneously assuring mechanical reinforcement of the cable connection to said first socket, whereby repeated interconnection of the first socket to said electrical equipment will not cause a disconnect to occur in any of said wires.

9. The cable connector of claim 8 wherein the equipment is provided with grounding means and said fingers come into contact with said grounding means upon cable connection to said second socket.

10. The cable connector of claim 8 wherein the transfer part is provided with guide strips to enable ease of assembly of the first socket within the second socket.

11. The cable connector of claim 8 including clamping means arranged to enclasp said transfer part to said cable at the encased grounding element.

12. The cable connector of claim 11 including a fastening means outboard of said grounding element encasing for enclasping said bundle of wires to said first socket.

13. A multi-wire cable connector for interconnecting a cable to a piece of electrical equipment, comprising in combination:

a cable having a plurality of conducting wires encased in a grounding element, said wires being stripped of their insulation at one end and extending past the grounding casing;

a first socket connected to said cable at said one end; and a transfer part in the form of a flat sheet adapted to be folded about said wires outboard of said grounding casing to enwrap same, said transfer part having a plurality of flexible contact fingers having elastic properties and bent into a U-shape, said transfer part being adapted to be engaged within said equipment to provide an electrical ground connection, and being in contact with said grounding casing and so constructed as to provided electrical continuity of the grounding element upstream of the first socket while simultaneously assuring mechanical reinforcement of the cable connection to said first socket, whereby repeated interconnection of the first socket to said electrical equipment will not cause a disconnect to occur in any of said wires.

14. A multi-wire cable connector comprising in combination:

a cable having a plurality of conducting wires and a grounding element;

a first socket connected to said cable;

a second socket mounted into a piece of electrical equipment and into which said first socket is to be connected; and a transfer part provided with a plurality of flexible contact fingers having elastic properties and bent into a U-shape, said transfer part being adapted to be engaged within said equipment to provide an electrical ground connection, and adapted to be connected to the grounding element of said cable and mechanically assembled to said first socket whereby electrical continuity of the grounding element is assured upstream of the first socket while simultaneously assuring mechanical reinforcement of the cable connection to said first socket, whereby repeated insertions and extractions of the first socket into the second socket will be withstood without causing electrical disconnect of any of said conducting wires, a fastening means outboard of said grounding element for enclasping said wires to said first socket.

15. A multi-wire cable connector for interconnecting a cable to a second socket mounted into a piece of electrical equipment comprising in combination:

a cable having a plurality of conducting wires encased in a grounding element, said wires being stripped of their insulation at one end and extending past the grounding casing;

a first multi-pin socket connected to said cable at said one end; and a transfer part provided with a plurality of flexible contact fingers having elastic properties and bent into a U-shape, said transfer part being adapted to be engaged within said equipment to provide an electrical ground connection, and adapted to be connected to the grounding element of said cable and mechanically assembled to said first socket whereby electrical continuity of the grounding element is assured upstream of the first socket while simultaneously assuring mechanical reinforcement of the cable connection to said first socket, whereby repeated interconnection of the first socket to said electrical equipment will not cause a disconnect to occur in any of said wires, a fastening means outboard of said grounding element casing for enclasping said bundle of wires to said first socket.

16. A multi-wire cable connector for interconnecting a flat cable to a receptacle socket joined to the printed circuit of an electrical equipment and mounted recessed with respect to and in the interior of an opening of the equipment comprising in combination:

a flat cable having a plurality of conducting wires encased in a grounding element, said wires being stripped of their insulation at one end and extending past the grounding casing;

a connection socket with two sides provided with holes and a rear being connected to said cable at said one end; and a transfer piece having a first part in the form of a flat sheet adapted to come into electrical contact with the grounding casing of said capable by means of a clamp formed by two jaws enclosing the first part of the transfer piece so as to provide electrical continuity of the ground element upstream of the connection socket and a second part arranged in a comb of teeth curved in a U-shape which extends by springing back to the rear of the connection socket to assure mechanical reinforcement of the cable connection to said connection socket, during the connection of the connection socket to the receptacle socket and a fastening piece in the form of a U with a central part and arms is mounted in such a way that on one side the control part of the U of the fast ring piece will be placed between the arms of the comb and prevented of removal by the clamp and on the other side the arms of the fastening piece provided with lugs clipping into corresponding holes provided on the side of the connection socket whereby repeated interconnection of the first socket to said electrical equipment will not cause a disconnect to occur in any of said wires.

* * * * *